US005247860A

United States Patent [19]

Karl et al.

[11] Patent Number: 5,247,860

[45] Date of Patent: Sep. 28, 1993

[54] FARM TOOL AND METHOD FOR THE PRODUCTION THEORY

[75] Inventors: Kurt Karl, Heilbronn; Armin Doering, Unterheinriet; Erich Lohner, Heilbronn, all of Fed. Rep. of Germany

[73] Assignee: Karrosseriewerke Weinsberg GmbH, Weinsberg, Fed. Rep. of Germany

[21] Appl. No.: 751,316

[22] Filed: Aug. 28, 1991

[51] Int. Cl.[5] ..... B21D 37/02

[52] U.S. Cl. ..... 76/107.1

[58] Field of Search ..... 76/107.1, 101.1

[56] References Cited

U.S. PATENT DOCUMENTS

| | | | |
|---|---|---|---|
| 2,447,620 | 8/1948 | Singleton | 76/107.1 |
| 3,167,976 | 2/1965 | Lalli | 76/107.1 |
| 3,343,430 | 9/1967 | Haras et al. | 76/107.1 |

FOREIGN PATENT DOCUMENTS

| | | | |
|---|---|---|---|
| 0029533 | 2/1983 | Japan | 76/107.1 |
| 0066026 | 3/1989 | Japan | 76/107.1 |

*Primary Examiner*—Roscoe V. Parker

*Attorney, Agent, or Firm*—Anderson Kill Olick & Oshinsky

[57] ABSTRACT

A method is proposed for the production of a form tool, particularly for the shaping of plate-shaped or web-shaped starting material containing fiber material, comprising at least one male mold part and female mold part which are provided with form surfaces and recesses for guiding heated gas or steam and the like to the form surfaces and with devices for clamping on an apparatus, and whose form surfaces are shaped and formed from a sheet metal material, particularly perforated sheet metal, wherein in order to prevent any reworking at the form surface it is provided that a tap model, which is constructed as a negative form of the corresponding part of an original model, is used for shaping the sheet metal forming the form surface of a tool half, both the female mold and the male mold of the form tool, and that the perforated sheet metal forming the form surface remains fixed on the tap model until the frame and the possibly necessary reinforcements are connected to its rear side, which is open at the top.

9 Claims, 2 Drawing Sheets

FARM TOOL AND METHOD FOR THE PRODUCTION THEORY

FIELD OF THE INVENTION

The present invention is directed to a method for the production of a form tool, as well as to a form tool produced according to this method, particularly for the shaping of plate-shaped or web-shaped starting material containing fiber material.

BACKGROUND OF THE INVENTION

Previously known form tools preferably used for shaping thin-walled web-shaped or plate-shaped starting material containing at least a fiber material component, have the starting material shaped by simultaneous or alternate application of pressure and heat. In so doing, it is absolutely necessary that the gap width remaining between the male mold and female mold when the form tool is closed and kept absolutely uniform along the entire contour or that it follow contours drawn beforehand.

According to a known method for the production of such form tools, particularly those with a form surface formed by perforated sheet metal, the two halves of the tool, male mold and female mold, of such form tools are produced in such a way that a tap model is, taken from an original model or in such a way that a tap model is prepared from a model drawing, wherein the tap model forms a mold exactly true to the shape of the original mold, i.e., a positive mold. The perforated sheet metal forming the form surface of the tool is tapped or shaped over the pastime mold until it forms a replica of the surface contour of the tap model which is completely true to shape. The perforated sheet metal forming the form surface is then removed from the tap model and connected with a circumferentially extending frame or housing body, and reinforcements, e.g. in the form of sheet metal webs or the like are arranged in a grid-like manner and are to be attached at its rear side if required and, are arranged simultaneously or subsequently, partially by means of welding or also with the use of other suitable connecting techniques.

Because of the properties of sheet metal and the spatially curved deformation of the sheet metal material forming the form surface, it is unavoidable that the sheet metal forming the form surface of the tool halves will spring up at first, at least in some places, after the removal of the tap model or that its desired contour will change in a comparable manner, so that an unwanted change in the contour of the form surface will naturally result. Further, partly because of the subsequent arrangement of the frame or housing body of the form half and partly to the subsequent connection of the reinforcements at the shaped perforated sheet metal forming the respective form surface, other distortions or changes in the shape of the perforated sheet metal take place, so that the form tool must be reworked in its entirety with respect to its dimensioning and the occurring changes in shape must be eliminated, accompanied by a considerable expenditure of work time.

Therefore, an object of the invention is to provide a manner of constructing a form tool and a method for the production of same which simplifies the production of the form tools from sheet metal material, in particular perforated sheet metal material, in such a way that the work expenditure for the preparation of the tool is reduced overall and, in particular, the expenditure for the reworking of the form surfaces on the finished tool which were prepared on the tap model is eliminated or at least limited to a practically negligible minimum.

SUMMARY OF THE INVENTION

These and other objects of the invention, which shall become apparent hereafter, are achieved by a method for the production of a form tool, as well as by a form tool produced according to this method, particularly for the shaping of plate-shaped or web-shaped starting material. The invention comprises at least one male mold and female mold part which are provided with form surfaces and recesses for guiding heated gas or steam and the like to the form surfaces and with devices for clamping on an apparatus, wherein at least one of the two form parts, male mold or female mold, comprises a housing body which is gas-tight with respect to its circumferential surfaces and comprises a form surface formed by sheet metal material, particularly perforated sheet metal, which is supported by means of supporting sheet metal sheets arranged in a grid-like manner and is provided with a plurality of through-openings for heated gas or the like.

This object is further met, according to the invention, in that a tap model constructed as a negative mold of the corresponding part of an original model is used for the shaping for the sheet metal forming the form surface of a tool half, the female mold as well as the male mold of the form tool. The tap model is provided as a negative mold of the original model, and the form surface of the tool produced on the latter or shaped like the latter is provided with a frame and reinforcements before it is removed from the tap model.

The connection of the frame or housing body and the reinforcing sheet metal sheets with the sheet metal forming the form surface of the tool half can be effected by means of welding without the perforated sheet metal, which forms the form surface and is fixed on the tap model, e.g. by means of screws, or the perforated sheet metal blanks which, in their entirety, form the form surface of the tool being able to spring up or otherwise change their shape.

BRIEF DESCRIPTION OF THE DRAWINGS

The invention will be better understood by the detailed description of the preferred embodiment in connection with the drawings, of which.

DETAILED DESCRIPTION OF THE PREFERRED EMBODIMENTS

Figure 1:
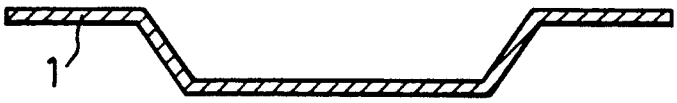
FIG. 1 shows a section through a plate-shaped material blank shaped by means of a form tool.
Figure 2:
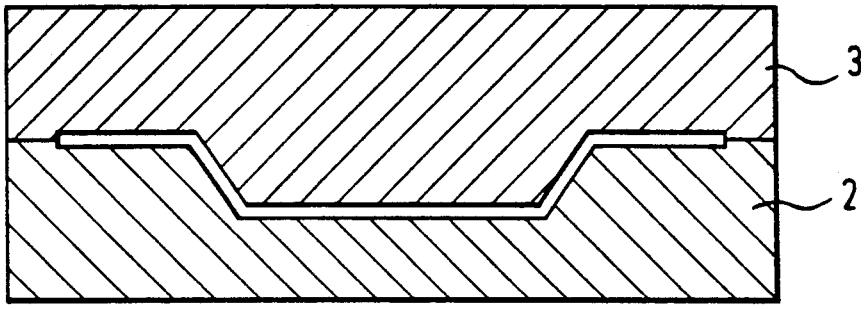
FIG. 2 shows a section through the original model of a form tool for effecting the shaping of the blank according to FIG. 1.
Figure 3A:
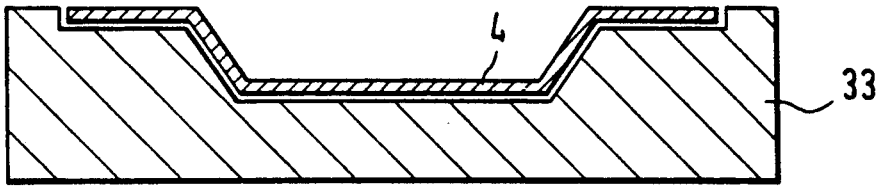
FIGS. 3*a* and 3*b* each show a section through the tap model taken from the original model for the form surface of the tool, according to FIG. 2.
Figure 3B:
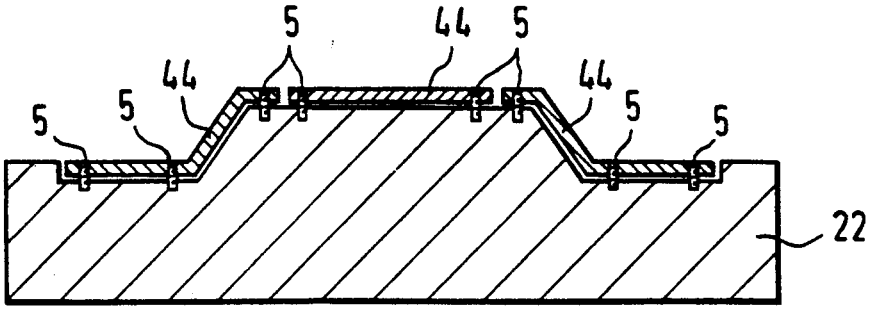
Figure 4:
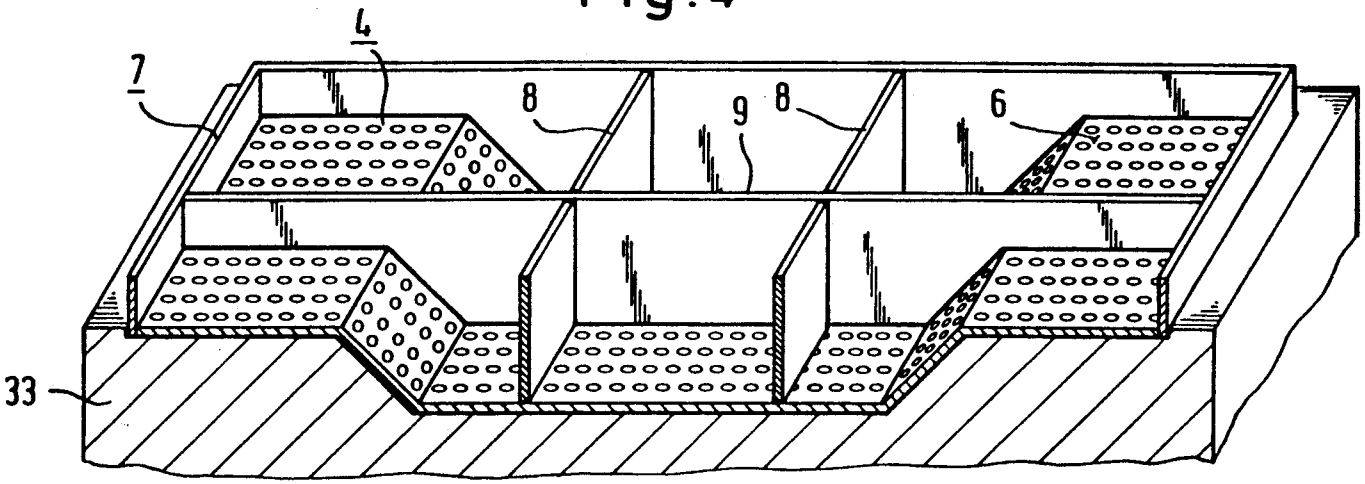
FIG. 4 shows a partially graphic view of the manner of production of the form tool on the tap model.
Figure 5:
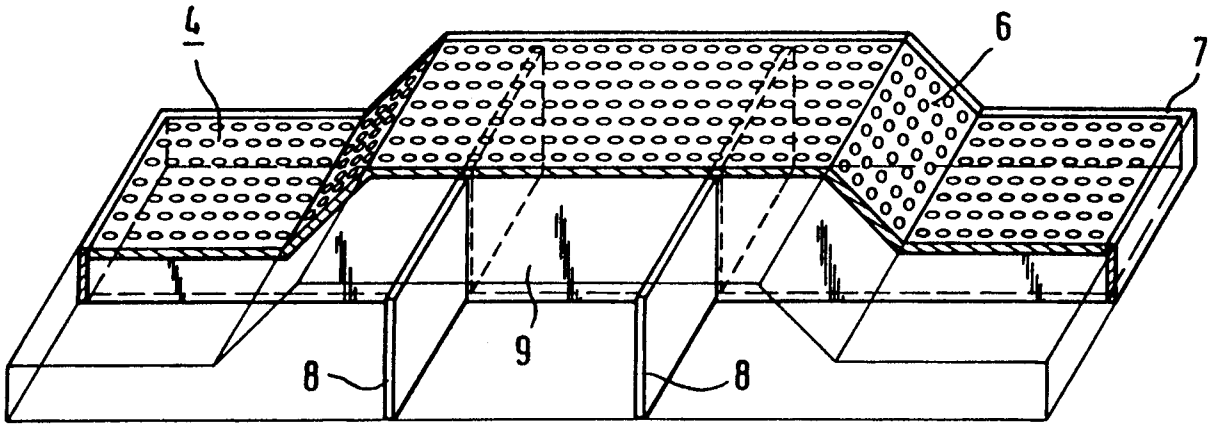
FIG. 5 shows a partially graphic view of a form tool produced with the method according to the invention.

Referring now to the drawings, wherein like numerals reflect like elements throughout the several views, FIG. 1 depicts the form part 1 from a plate-shaped or web-shaped starting material, of a form tool. The form part 1 is shown in FIG. 1 as a simple trough-shaped part for the sake of simplicity, the original model of a form tool, which can be seen from FIG. 2 and comprises a female mold 2 and a male mold 3, is first prepared with reference to a starting drawing.

A tap model 33 and 22, respectively, is then prepared, based on this original model, for both the female mold 2 and male mold 3 in each instance, wherein the two tap models 22 and 33 are the negative mold of the corresponding male mold 3 or female mold 2 of the original model.

A one-piece perforated sheet metal blank 4 is now placed on these tap models 22, 33 and shaped in such a way as to accurately correspond to the shape of the tap model, or a plurality of perforated sheet metal blanks 44 are placed on the tap model 22, 23 in succession and likewise successively shaped so as to corresponding to the shape of the tap model. In so doing, in the course of shaping or after the shaping of the one-piece perforated sheet metal 4 is completed, the latter 4 can be fastened at the tap model 22 and 33, respectively, by means of suitable fastening means, which are shown in the drawing as screws 5, so that a subsequent springing up of the shaped perforated sheet metal 4 is completely ruled out. Since the tap model is constructed as a negative mold, the perforated sheet metal forming the form surface of the tool is shaped, proceeding from its rear side, corresponding to the contour of the intended form surface and, in contrast to the conventional manner of working, the rear side also remains accessible for the arrangement of the frame and the reinforcements, which may possible be attached, without the need to remove the sheet metal forming the form surface from the tape model. One of the advantages resulting from this is that the form surface prepared on the tap model can remain on the latter until it is connected with the frame or housing body of the tool half and is possibly provided with the required reinforcements, so that the possibility of a springing back of the perforated sheet metal forming the form surface when removed from the tap model and the occurrence of distortions when joining, particularly welding, the frame and/or the reinforcements are eliminated, if not absolutely, then to such an extent that a reworking of the shaped perforated sheet metal, i.e. the form surface of the tool half, can no longer occur or only to a very limited extent.

With perforated sheet metal sheets 44 consisting of a plurality of blanks, it is provided that the latter be fixed relative to one another and relative to the tap model 22 and 33, respectively, by means of suitable fastening means, in this case screws 5, particularly so as to directly follow the course of shaping.

Accordingly, perforated sheet metal extending over large surfaces can also be fastened on the tap model in such a way that it cannot spring up or otherwise change in shape either during the shaping or during the arrangement of the frame or reinforcements.

After the perforated sheet metal 4 and 44, respectively, forming the form surface 6 of a form tool half is formed in this way so as to accurately correspond to the shape of the tap model 22 and 33, respectively, a circumferentially extending, particularly gas-tight frame or housing body 7 is connected to the rear side of the perforated sheet metal 4 and 44, respectively, when the latter remains fixed on the tap model 22 and 33, respectively, this being effected in the shown embodiment example by means of welding.

Similarly, the reinforcements shown in the embodiment example, which comprise longitudinal and transverse sheet metal sheets 8 and 9 which are aligned vertically relative to one another and arranged in a grid-like manner, are then connected to the rear side of the perforated sheet metal 4 and 44, respectively, forming the form surface of the form tool half, which can also be effected by means of welding. Only after the respective half of the form tool, female mold or male mold, is completely finished in this manner, particularly stiffened with respect to the perforated sheet metal 4, respectively, 44 forming the form surface, its fastening at the tap model 2 and 33, respectively, is detached and the finished tool half is removed from the tap model 22 and 33, respectively. Since changes in shape, particularly a springing up or distortion, of the perforated sheet metal sheet 4, respectively, 44 forming the form surface are no longer possible after the arrangement of the frame or housing body and the provided reinforcements, a further treatment of the form tool produced with the method according to the invention is no longer required.

In another construction of the invention, it can be provided, particularly for large-area form tools, that the sheet metal forming the form surface of the tool half is composed in its entirety of a number of independent blanks and that the latter are successively placed on the tap model, shaped corresponding to the latter and connected with one another. In so doing, the sheet metal blanks are connected with one another so as to lie on and be fastened to the tap model, so that the mutual connection of the individual sheet metal blanks forming the form surface can be carried out without springing up or like changes in shape.

The connection of the frame or housing body and the reinforcing sheet metal sheets with the sheet metal forming the form surface of the tool half can be effected by means of welding without the perforated sheet metal, which forms the form surface and is fixed on the tap model, e.g. by means of screws, or the perforated sheet metal blanks which, in their entirety, form the form surface of the tool being able to spring up or otherwise change their shape.

While the preferred embodiments of the invention has been described in detail, various modifications and adaptations may be made thereto, without departing from the spirit and scope of the invention, as delineated in the following claims:

We claim:

1. A method of producing a form tool, particularly for shaping of plate-shaped or web-shaped material containing fiber material, said method comprising the steps of:

providing female and male mold parts having respective form surfaces, a plurality of through-openings for delivery one of a hot gas and vapor to the form surfaces, and respective means for clamping said male and female parts on a apparatus;

providing at least one of said female and male mold parts with a frame or housing body which is gas-tight with respect to an outer surface of said at least one of said female and male mold parts;

providing a perforated sheet metal for forming the form surface of said at least one of said female and male mold parts, with perforations of said sheet metal defining said through-openings for delivery one of a hot gas and vapor;

providing sheet metal means arranged in a grid-like manner for supporting said perforated sheet metal; and using a tap model, which is constructed as a negative form of a corresponding part of an original model, for shaping the sheet metal which forms the form surface of the respective one of said female and male mold parts.

2. The method of claim 1, further comprising the steps of fixing said perforated sheet metal on the tap model during or after the shaping of the perforated sheet metal by suitable fastening or retaining means; and connecting said perforated sheet metal at its upper free rear side with said gas-tight frame or housing body, which extends circumferentially.

3. The method of claim 2, further comprising the step of connecting said sheet metal means, simultaneously with or after the connection of said frame or the housing body, to the upper free rear side of said perforated sheet metal, which rear side is open at the top.

4. The method of claim 1, further comprising the step of forming said perforated sheet metal of a plurality of connectable-to-each other individual blanks.

5. The method of claim 4, further comprising the step of placing said individual blanks in succession on the tap model and fixing said individual blanks thereto so that said individual blanks correspond to a shape thereof.

6. A form tool, particularly for shaping of plate-shaped or web-shaped material containing fiber material, said form tool comprising:

female and male mold parts having respective form surfaces, a plurality of through-openings for delivery one of a hot gas and vapor to the form surfaces, and respective means for clamping said male and female parts on apparatus;

a frame or a housing body which is attached to at least one of said female and male mold parts and is gas-tight with respect to an outer surface of said at least one of said female and male mold parts;

a perforated sheet metal forming the form surface of said at least one of said female and make mold parts, with perforations of said sheet metal defining said through-openings for delivery one of a hot gas and vapor; and sheet metal means arranged in a grid-like manner for supporting said perforated sheet metal;

wherein said perforated sheet metal is shaped by using a tap model, which is constructed as a negative form of a corresponding part of an original model.

7. The form tool of claim 6, wherein said perforated sheet metal is connected, at its upper free rear side with said frame or housing body, which extends circumferentially.

8. The form tool of claim 6, wherein said supporting sheet metal means is connected at said rear side of said perforated sheet metal, said rear side being open at the top.

9. The form tool of claim 6, wherein said perforated sheet metal comprises a plurality of individual blanks connected to one another.

* * * * *